United States Patent [19]

Kajimura et al.

[11] Patent Number: 5,026,521

[45] Date of Patent: Jun. 25, 1991

[54] ZIRCONIUM-TITANIUM AND/OR TANTALUM OXYGEN ALLOY

[75] Inventors: Haruhiko Kajimura; Hiroo Nagano, both of Kobe; Kazuo Yamanaka, Minoo; Tsuyoshi Kodama, Otsu, all of Japan

[73] Assignee: Sumitomo Metal Industries, Ltd., Osaka, Japan

[21] Appl. No.: 447,843

[22] Filed: Dec. 8, 1989

[30] Foreign Application Priority Data

May 8, 1989 [JP] Japan ..... 1-114789
Sep. 21, 1989 [JP] Japan ..... 1-245419

[51] Int. Cl.[5] ..... C22C 15/00
[52] U.S. Cl. ..... 420/422; 148/11.5 F
[58] Field of Search ..... 420/422; 148/11.5 F

[56] References Cited

U.S. PATENT DOCUMENTS

| | | | |
|---|---|---|---|
| 2,926,981 | 3/1960 | Stout et al. | 420/422 |
| 3,271,205 | 9/1966 | Winton et al. | 420/422 |
| 3,472,704 | 10/1969 | Watson et al. | 148/3 |
| 3,666,429 | 5/1972 | Campbell, Jr. et al. | 420/422 |
| 4,082,834 | 4/1978 | Grossman et al. | 420/422 |

FOREIGN PATENT DOCUMENTS

| | | | |
|---|---|---|---|
| 33-5704 | 7/1958 | Japan . | |
| 62-222037 | 9/1987 | Japan . | |
| 1084250 | 9/1967 | United Kingdom | 420/422 |

OTHER PUBLICATIONS

"The Metallugy Of Zirconium", by B. Lustman et al., McGraw-Hill Book Company, Inc., pp. 196–197 and pp. 438–439, 1955.

"SCC Of Zirconium And Its Alloys In Nitric Acid", by Te-Lin Yau, Nat'l Assoc. of Corrosion Eng., vol. 39, No. 5, pp. 167–174, May 1983.

Mukhopadhyay et al., Z. Metallkde, 69 (1978), 725.

Van Thyne et al., Trans. ASM, 48 (1955), 1–14.

*Primary Examiner*—Upendra Roy

*Attorney, Agent, or Firm*—Burns, Doane, Swecker & Mathis

[57] ABSTRACT

A zirconium alloy which has good creep strength and bending properties as well as improved corrosion resistance in nitric acid solutions of low, medium, and high concentrations and which can withstand stress corrosion cracking in highly concentrated nitric acid solutions even under a high anodic potential is disclosed. The zirconium alloy consists essentially of, by weight percent:

one or both of Ti: 5.0–30% and Ta: 1.0–20%,
Fe: not greater than 0.3%, Cr: not greater than 0.1%,
Oxygen: 0.05–0.2%, N: not greater than 0.45%,
H : not greater than 0.01%,
one or more of W, V, and Mo: 0–3.0% in total, and the balance Zr and inevitable impurities.

18 Claims, 1 Drawing Sheet

ZIRCONIUM-TITANIUM AND/OR TANTALUM OXYGEN ALLOY

BACKGROUND OF THE INVENTION

The present invention relates to a zirconium alloy having improved corrosion resistance in nitric acid and good creep strength and bending properties. More particularly, it relates to a zirconium alloy which has improved resistance to stress corrosion cracking even in highly concentrated nitric acid solutions having a concentration above the azeotropic concentration at elevated temperatures and which is suitable for use as a structural material in various industrial plants which are exposed to a nitric acid solution, such as plants for the production of nitric acid.

Nitric acid solutions, particularly concentrated nitric acid solutions at an elevated temperature or highly oxidizing nitric acid solutions which contain oxidizing ions such as $Cr^{6+}$ ions or $Ce^{4+}$ ions cause corrosion of stainless steels to such a great extent that stainless steels are not suitable for use in environments in which they are exposed to these nitric acid solutions. Instead, nonferrous materials are used in these environments.

Titanium, a representative nonferrous corrosion-resistant metallic material, corrodes at a high rate in nitric acid. It is also known that titanium may ignite or explode in fuming nitric acid.

It is well known that zirconium (Zr) exhibits excellent corrosion resistance, particularly resistance to general corrosion and intergranular corrosion in nitric acid environments. Therefore, it has been frequently used as structural materials for industrial plants which are exposed to nitric acid.

Nitric acid and water form an azeotropic mixture at a concentration of 69.8% $HNO_3$ which corresponds to a specific gravity of 1.42. Thus, aqueous nitric acid solutions have a maximum boiling point of 123° C. at the azeotropic concentration. Due to the formation of the azeotropic mixture, it is not possible to concentrate nitric acid solutions beyond the azeotropic point by ordinary distillation techniques. Therefore, in the commercial production of highly concentrated nitric acid solutions having a concentration above the azeotropic point, a special procedure for concentration such as dehydration with sulfuric acid must be employed.

A plant for the production of highly concentrated nitric acid solutions is inevitably exposed to a concentrated nitric acid having a concentration higher than the azeotropic concentration.

It is known that the behavior of zirconium to corrosion in nitric acid solutions varies significantly when the concentration is increased above the azeotropic concentration. For example, it is reported by Te-Lin Yau in Corrosion, 39 (1983), p. 167 that pure zirconium and its alloys (Zr-1.5Sn and Zr-2.5Nb) are susceptible to stress corrosion cracking (SCC) in a nitric acid solution having a concentration higher than the azeotropic concentration (about 70%). Usually, the corrosion resistance of a metal improves with decreasing temperature, but the above-mentioned SCC susceptibility of zirconium and its alloys can be observed even at room temperature.

Therefore, the corrosion resistance of zirconium and conventional zirconium alloys is not sufficient for them to be used as a structural material for a plant for the production of nitric acid which may be exposed to highly concentrated nitric acid at a concentration above the azeotropic point. Presently, there is no material in the prior art which is known to be suitable for use as a structural material for such a plant. Nitric acid production plants now in use are usually made of either a stainless steel or a nonferrous metal-based alloy, but due to the high corrosion rates of these structural materials, frequent replacement of the equipments and fittings is necessary, which leads to great economic losses.

It is also known that the presence of a large amount of oxidizing ions such as $Cr^{6+}$ and $Ce^{4+}$ in nitric acid solutions may adversely affect the resistance of zirconium to SCC in nitric acid since the oxidative nature of the solutions is increased. An increase in the oxidative nature of a nitric acid solution also occurs when an additional anodic potential is applied to zirconium to cause anodic polarization, and the resistance of zirconium to SCC in nitric acid may be adversely affected in this case, too.

Japanese Patent Laid-Open Application No. 62-222037(1987) discloses a zirconium alloy containing 0.1–50% Ti. The zirconium alloy has improved resistance to general corrosion in highly oxidizing nitric acid solutions such as those in which a high anodic potential is applied. Such general corrosion is known as corrosion under high potential. However, there is no teaching in the laid-open application about the resistance of the alloy to SCC in nitric acid. Furthermore, it does not suggest the effects of impurities in the alloy nor the criticality of impurity level to attain satisfactory creep strength and SCC resistance.

Japanese Patent Publication No. 33-5704(1958) discloses a corrosion-resistant zirconium alloy containing 1–50% Ti. However, the corrosion resistance referred to in this publication is evaluated in hydrochloric acid and sulfuric acid, and its resistance to corrosion in nitric acid is not disclosed. In addition, there is no reference to the effects of impurities in the alloy, as in the above-mentioned Japanese laid-open application.

It is desirable for structural materials which are used in nitric acid environments to withstand corrosion including general corrosion and stress corrosion cracking not only in highly concentrated nitric acid solutions but in nitric acid solutions of low to medium concentrations at both ambient and elevated temperatures. In addition, the structural materials must have good mechanical properties. However, the corrosion resistance of zirconium metal is insufficient as described above, and its mechanical properties are also unsatisfactory. Specifically, the tensile strength of zirconium is low and its rate of decrease in tensile strength with increasing temperature is higher than that of stainless steels. Moreover, the creep strength of zirconium is not sufficient even in the temperature range of 100°–200° C. which is employed in nitric acid production plants.

SUMMARY OF THE INVENTION

An object of the present invention is to provide a zirconium alloy which has a low corrosion rate in nitric acid solutions of low, medium and high concentrations, a good resistance to corrosion including SCC even under a high anodic potential, and a high creep strength and good bending properties.

Another object of the invention is to provide a zirconium alloy which has improved resistance to corrosion, particularly to SCC, in highly concentrated nitric acid solutions at a concentration above the azeotropic point and which can be satisfactorily used as a structural material for a nitric acid production plant.

The present invention provides a zirconium alloy having improved resistance to general corrosion and SCC in nitric acid and good creep strength and bending properties, which consists essentially of, by weight percent:

one or both of Ti: 5.0–30% and Ta: 1.9–20%,
Fe: not greater than 0.3%, Cr: not greater than 0.1%,
oxygen: 0.05–0.2%, N: not greater than 0.05%,
H: not greater than 0.01%,
optionally one or more of W, V, and Mo: not greater than 3% in total, and the balance Zr and inevitable impurities.

DETAILED DESCRIPTION OF THE PREFERRED EMBODIMENTS

Figure 1:
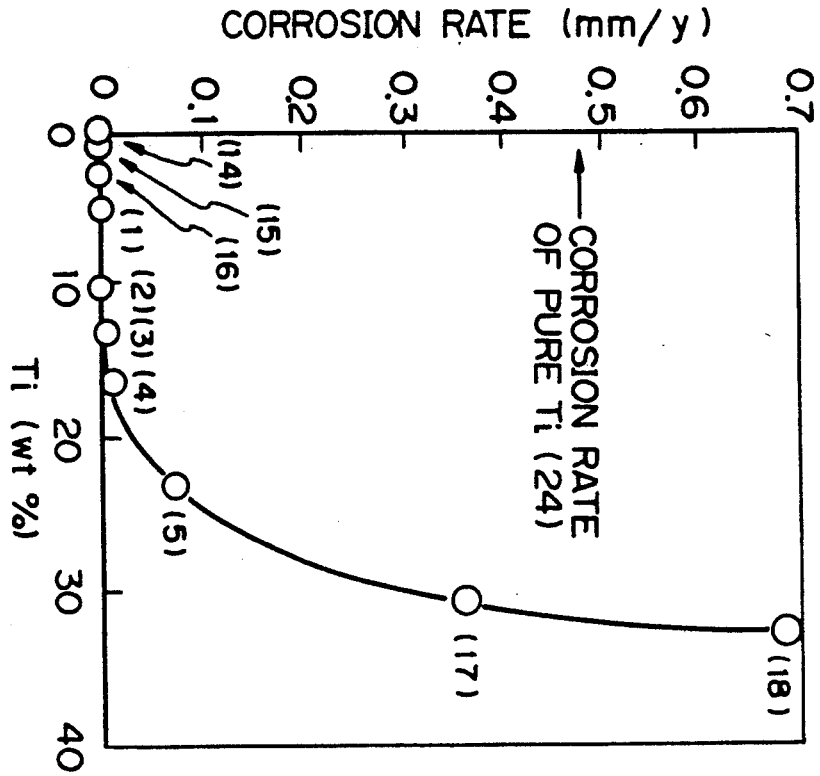
FIGS. 1 and 2 are graphs showing the effects of titanium content and the total content of W, V, and Mo, respectively, on the corrosion rate of zirconium alloys in a boiling 40% $HNO_3$ solution.

The zirconium alloy according to the present invention has satisfactory resistance to corrosion including general corrosion and SCC in nitric acid solutions of low, medium and high concentrations even when an increased anodic potential is applied or the solutions contain oxidizing ions. Thus, it can withstand SCC well in highly concentrated nitric acid solutions at a concentration above the azeotropic point (about 70%). Furthermore, the alloy has good creep strength and bending properties so that its mechanical strength and workability are sufficient for it to be used as a structural material in various nitric acid environments.

The zirconium alloy can be satisfactorily employed as a structural material for the construction of a plant for the production of nitric acid. It can also be used as structural materials for other plants which are exposed to nitric acid solutions of various concentrations. Pure zirconium metal cannot be used in an environment which is exposed to a highly oxidizing nitric acid solution of a high concentration at an elevated temperature due to its susceptibility to SCC. However, the zirconium alloy of the present invention can be used in such an environment.

The composition of the zirconium alloy according to the present invention is restricted to the above-described limits for the reasons set forth below. In the following description, all the percents are by weight unless otherwise indicated.

Ti (titanium):

Titanium can form a solid solution with zirconium in all proportions without formation of a brittle intermetallic compound. It has been found that corrosion resistance, particularly resistance to SCC of zirconium in a highly concentrated nitric acid solution can be effectively suppressed by addition of titanium. For this purpose, it is necessary to add titanium in an amount of at least 5.0%. When the alloy is used as a structural material which is exposed to nitric acid at a concentration above the azeotropic point, the titanium content is preferably at least 10% to assure that the material is prevented from SCC in such severe environments. Addition of an excessively large amount of titanium may adversely affect the bending properties and workability of the resulting alloy. Therefore, the maximum content of titanium is 30%, and preferably 25%.

Ta (tantalum):

Like titanium, addition of tantalum serves to improve the resistance of zirconium to SCC in nitric acid. For this purpose, at least 1.0% of tantalum is added to zirconium, in place of titanium or in combination with titanium. When the alloy is used as a structural material which is exposed to nitric acid at a concentration above the azeotropic point, it is preferable that the tantalum content, when present in the alloy, be at least 5.0% and more preferably at least 10%. In view of the workability and material cost, the maximum tantalum content should be 20%, and preferably 15%.

In an alloy containing both titanium and tantalum, the content of either one of these elements may be lower than the above-described minimum content for the element. Fe (iron) and Cr (chromium):

These elements form intermetallic compounds with zirconium. Since the intermetallic compounds are brittle and tend to serve as starting points of SCC, they deteriorate the bending properties of the alloy. Therefore, in the alloy of the present invention, the content of Fe should not exceed 0.3% and preferably 0.15%, while that of Cr should not exceed 0.1% and preferably 0.05%.

Oxygen:

Oxygen is added in an amount of at least 0.05% in order to improve the creep strength of the zirconium alloy. The maximum oxygen content is 0.2% since a higher oxygen content may adversely affect the bending properties and workability of the alloy. Preferably the oxygen content is in the range of 0.08–0.15%.

N (nitrogen):

The nitrogen content of the alloy is restricted to not greater than 0.05% and preferably not greater than 0.01% since the presence of nitrogen in a larger amount may deteriorate the bending properties and workability of the alloy.

H (hydrogen):

Hydrogen forms hydrides with the metallic elements present in the alloy. The hydrides adversely affect the bending properties of the alloy. Therefore, the hydrogen content is restricted to not greater than 0.01% and preferably not greater than 0.005%.

W (tungsten), V (vanadium), and Mo (molybdenum):

Each of tungsten, vanadium, and molybdenum has the effect of improving the corrosion resistance and creep strength of the zirconium alloy. Therefore, if desired, one or more of these elements may be added to the alloy. However, if added in an excessively large amount, these elements may deteriorate the corrosion resistance. Therefore, the total amount of W, V, and Mo, when they are added, is restricted to not greater than 3.0%, and preferably not greater than 2.0%. In order to achieve the desired effect by the addition of these elements sufficiently, it is preferable to add one or more of W, V, and Mo in a total amount of at least 0.05%.

The balance of the alloy of the present invention is comprised of zirconium and inevitable impurities. Possible impurities include Hf in an amount of less than 4.5%.

The present invention will be described more fully by the following examples. These examples are intended to merely illustrate the invention without limiting it. It should be understood that various modifications and variations may be employed by those skilled in the art without departing from the scope of the invention.

EXAMPLES

EXAMPLE 1

Zirconium alloys having the compositions shown in Table 1 were prepared by vacuum melting a mixture of zirconium and titanium and/or tantalum, and, if necessary, one or more other metallic elements, followed by hot rolling and annealing at 700° C.

The resulting alloys were subjected to a corrosion test in nitric acid, a bending test, and a creep test in the manner set forth below.

The corrosion test was performed with plate-shaped test pieces measuring 3 mm (t)×10 mm (w)×40 mm long.

Some of the test pieces were used to determine the corrosion rate by immersing them in a boiling 40% $HNO_3$ solution five times each for 48 hours in order to evaluate their resistance to general corrosion. After each time of immersion, the weight loss of the test piece was measured, and the total weight loss was determined. The corrosion rate was expressed in terms of reduction in thickness per year (mm/y) which was calculated from the total weight loss and the density of the tested alloy.

The other corrosion test pieces were used to determine the resistance to SCC. The SCC test was performed with a test piece to which a constant anodic potential of 1.4 V vs S.C.E. and a constant stress were applied while it was immersed in a boiling 40% $HNO_3$ solution.

In the evaluation of resistance to SCC, an important parameter is the maximum stress expressed as a fraction of the offset yield strength which the test piece can withstand without creating SCC. In this example, the resistance to SCC of a test piece was evaluated by measuring the length of time elapsed until the rupture of the test piece when a constant stress corresponding to 0.4 to 0.8 times its 0.2% offset yield strength ($\sigma_y$, which is also called proof strength) at 110° C. was applied to the test piece. The maximum test period for each test run was 500 hours.

The bending test was performed by bending a test piece in the form of a 2 mm-thick plate with a bend radius of 6 mm, and visually observing whether there were any cracks in the test piece.

The creep test was performed at 150° C. using a test piece in the form of a flanged tensile test bar having a diameter of 6 mm in the parallel portion. The results were recorded in terms of the stress applied to the test piece when the minimum creep rate reached $10^{-3}$%/h.

Figure 2:
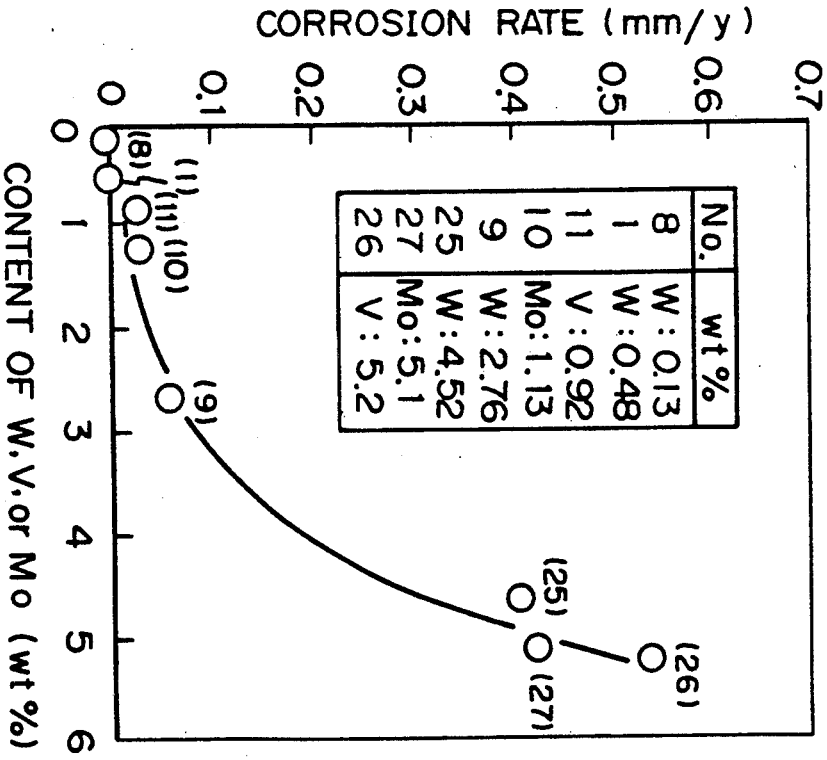

The test results are summarized in FIGS. 1 and 2 and Table 1.

FIGS. 1 and 2 shows the corrosion rate in the corrosion test. The reference numbers in the figures correspond to the alloy numbers in Table 1. As can be seen from FIG. 1, addition of titanium in excess of 30% (Alloys Nos. 17 and 18) caused a rapid increase in the corrosion rate of the zirconium alloy. Likewise, pure titanium had a poor corrosion resistance (Alloy No. 24). In contrast, pure zirconium (Alloy No. 14) and zirconium alloys containing 30% or less titanium exhibited a low corrosion rate or good corrosion resistance in nitric acid.

FIG. 2 shows the effect of the total content of W, V, and Mo on the corrosion rate of 5% Ti—Zr alloys. When the total content of W, V, and Mo exceeded 3.9%, the resulting zirconium alloy had a significantly decreased corrosion resistance in nitric acid.

The resistance to SCC in a boiling $HNO_3$ solution under a constant anodic potential of 1.4 V vs S.C.E. and a constant stress are included in Table 1. Pure zirconium (Alloy No. 14, ASTM R60702) caused SCC when a stress in excess of 0.4 $\sigma_y$ was applied. When the content of titanium was less than 5.0% or the content of tantalum was less than 1.0% (Alloys Nos. 15, 16, and 29), the resistance to SCC in nitric acid was at the same level as for pure zirconium so that SCC was observed when a stress in excess of 0.4 $\sigma_y$ was applied. In contrast, with zirconium alloys according to the present invention which contained at least 5.0% Ti or at least 1.0% Ta, no SCC was observed even when a stress of 0.8 $\sigma_y$ was applied. However, when the content of Fe or Cr exceeded 0.3% or 0.1%, respectively, SCC took place even if at least 5.0% Ti was added to the zirconium alloy. It is believed that the presence of a large amount of Fe or Cr causes the formation of significant amounts of intermetallic compounds, which tend to initially corrode and hence serve as stress concentrators, thereby increasing the susceptibility of the alloy to SCC.

The results of the bending test and the creep test are also included in Table 1. It can be seen from Table 1 that the bending strength deteriorated when the alloy contained H, N, or oxygen in a larger amount (Alloys Nos. 21–23).

Pure zirconium and zirconium alloys which contained less than 5.0% Ti or less than 1.0% Ta (Alloys Nos. 14, 28 and 29) had rather low creep strengths. When the oxygen content was less than 0.05% (Alloy No. 19), the creep strength was also poor. It is desirable for zirconium alloys for use as structural materials to have a creep strength of at least 23 kgf/mm$^2$ under the test conditions employed herein. All the tested zirconium alloys according to the present invention had values for creep strength of greater than 25 kgf/mm$^2$.

TABLE 1

| No. | Composition of tested alloy (wt %) Ti | Ta | Fe | Cr | H | N | O | W | V | Mo | Bend Test | 0.2% proof strength ($\sigma_y$) at 110° C. (kgf/mm$^2$) | Resistance to SCC (hr) Applied stress (kgf/mm$^2$) $0.8\sigma_y$ | $0.6\sigma_y$ | $0.4\sigma_y$ | Creep strength (kgf/mm$^2$) (Stress at which minimum creep rate reaches $10^{-3}$%/h) | Remarks |
|---|---|---|---|---|---|---|---|---|---|---|---|---|---|---|---|---|---|
| 1 | 5.14 | — | 0.147 | 0.014 | 0.0017 | 0.0013 | 0.114 | 0.48 | — | — | O | 30.2 | No SCC | No SCC | — | 30.6 | This |
| 2 | 10.31 | — | 0.143 | 0.012 | 0.0011 | 0.0042 | 0.122 | 0.23 | 0.21 | 0.25 | O | 42.6 | No SCC | No SCC | — | — | Invention |
| 3 | 13.57 | — | 0.201 | 0.082 | 0.0010 | 0.0019 | 0.117 | 0.49 | — | — | O | 44.2 | No SCC | No SCC | — | — | |
| 4 | 16.15 | — | 0.079 | 0.023 | 0.0013 | 0.0017 | 0.113 | 0.52 | — | — | O | 46.2 | No SCC | No SCC | — | — | |
| 5 | 23.73 | — | 0.078 | 0.012 | 0.0012 | 0.0017 | 0.115 | 0.52 | — | — | O | 51.4 | No SCC | No SCC | — | — | |
| 6 | 5.21 | — | 0.063 | 0.012 | 0.0008 | 0.0011 | 0.062 | 0.42 | — | — | O | 27.1 | No SCC | No SCC | — | — | |
| 7 | 5.26 | — | 0.058 | 0.013 | 0.0016 | 0.0012 | 0.162 | 0.45 | — | — | O | 35.6 | No SCC | No SCC | — | — | |
| 8 | 5.23 | — | 0.121 | 0.013 | 0.0010 | 0.0013 | 0.112 | 0.13 | — | — | O | — | — | — | — | 26.1 | |
| 9 | 5.21 | — | 0.135 | 0.013 | 0.0011 | 0.0012 | 0.110 | 2.76 | — | — | O | — | — | — | — | 41.2 | |
| 10 | 5.18 | — | 0.132 | 0.012 | 0.0009 | 0.0014 | 0.113 | — | — | 1.13 | O | — | — | — | — | 38.0 | |
| 11 | 5.25 | — | 0.133 | 0.012 | 0.0008 | 0.0013 | 0.113 | — | 0.92 | — | O | — | — | — | — | 36.7 | |
| 12 | — | 5.14 | 0.071 | 0.013 | 0.0010 | 0.0017 | 0.121 | — | — | — | O | 39.8 | No SCC | No SCC | No SCC | 35.6 | |
| 13 | 5.56 | 10.12 | 0.069 | 0.021 | 0.0013 | 0.0013 | 0.097 | — | — | — | O | 58.2 | No SCC | No SCC | No SCC | 50.8 | |
| 14 | —* | —* | 0.073 | 0.012 | 0.0012 | 0.0012 | 0.112 | — | — | — | O | 24.8 | 42 | 240 | No SCC | 18.2 | Comparative |
| 15 | 0.82 | — | 0.072 | 0.015 | 0.0009 | 0.0010 | 0.110 | 0.50 | — | — | O | 26.1 | 30 | 315 | No SCC | — | |
| 16 | 2.95 | — | 0.083 | 0.012 | 0.0032 | 0.0012 | 0.065 | 0.51 | — | — | O | 28.7 | 54 | 330 | No SCC | — | |
| 17 | 30.55 | — | 0.081 | 0.015 | 0.0008 | 0.0012 | 0.120 | 0.52 | — | — | O | — | — | — | — | — | |
| 18 | 32.51 | — | 0.082 | 0.015 | 0.0009 | 0.0013 | 0.119 | 0.48 | — | — | O | — | — | — | — | — | |
| 19 | 5.07 | — | 0.059 | 0.011 | 0.0007 | 0.0010 | 0.030 | 0.47 | — | — | O | 28.7 | 297 | No SCC | No SCC | 19.4 | Comparative |
| 20 | 5.06 | — | 0.381 | 0.215 | 0.0007 | 0.0012 | 0.122 | 0.47 | — | — | O | — | 472 | No SCC | — | — | |
| 21 | 5.16 | — | 0.085 | 0.016 | 0.0090 | 0.0850 | 0.120 | 0.50 | — | — | X | — | — | — | — | — | |
| 22 | 5.02 | — | 0.076 | 0.018 | 0.0125 | 0.0131 | 0.166 | 0.51 | — | — | X | — | — | — | — | — | |
| 23 | 5.17 | — | 0.080 | 0.016 | 0.0098 | 0.0144 | 0.284 | 0.48 | — | — | X | — | — | — | — | — | |
| 24 | Balance** | — | 0.066 | 0.018 | 0.0019 | 0.0061 | 0.072 | — | — | — | O | — | — | — | — | — | |
| 25 | 5.10 | — | 0.110 | 0.013 | 0.0009 | 0.0012 | 0.114 | 4.52 | — | — | O | — | — | — | — | — | |
| 26 | 5.26 | — | 0.117 | 0.012 | 0.0011 | 0.0013 | 0.112 | — | 5.2 | — | O | — | — | — | — | — | |
| 27 | 5.22 | — | 0.121 | 0.015 | 0.0012 | 0.0012 | 0.110 | — | — | 5.1 | O | — | — | — | — | — | |
| 28 | 4.17 | — | 0.125 | 0.013 | 0.0010 | 0.0012 | 0.111 | — | — | — | O | — | — | — | — | 21.7 | |
| 29 | — | 0.21 | 0.087 | 0.019 | 0.0016 | 0.0041 | 0.108 | — | — | — | O | 25.6 | 40 | 270 | No SCC | 19.8 | |

(Note) Chemical Composition:
The balance is zirconium except for Alloy No. 24 in which the balance is Ti.
Underlined contents are outside the range of the present invention.
—: Not added.
*Pure zirconium; **Pure titanium.
Bending test: O: No cracking; X: Cracking.
0.2% Proof Strength: —: Not tested.
Resistance to SCC: — : Not tested; : Creep rupture;
The figures indicate the time in hour at which SCC occurred;
No SCC: No stress corrosion cracking occurred within 500 hour test period.
Creep test: —: Not tested.

EXAMPLE 2

Zirconium alloys having the compositions shown in Table 2 were prepared by vacuum melting a mixture of zirconium and titanium and/or tantalum, and, if necessary, one or more other metallic elements, followed by hot rolling and annealing at 650° C.

The resulting alloys were subjected to a SSRT (slow strain rate technique) test for the evaluation of resistance to SCC, a bending test, and a creep test.

The SSRT test was performed by using a tensile test piece having a parallel portion measuring 3 mm in diameter×20 mm long. It was stretched in a boiling nitric acid solution until rupture at a strain rate of $2.17\times10^{-6}$ $S^{-1}$ with or without an anodic potential being positively applied. When no potential was positively applied, the nitric acid solution had different concentrations ranging from 40% to 98%. The azeotropic concentration is 69.8%, but for simplicity, it will be hereunder indicated as 70%. In the cases where an anodic potential was applied, the nitric acid solution used had a constant concentration of 70% (azeotropic concentration) and the potential was varied within the range of 1.3 to 1.5 V vs S.C.E.

The occurrence of SCC was evaluated based on the amount of strain at rupture and observation of the fractured surfaces. The amount of strain at rupture in the nitric acid solution was compared to that obtained in a tensile test performed in a silicone oil in the same manner and at the same temperature as described above. When the amount of strain at rupture in the nitric acid solution was smaller than that in the silicone oil and the fractured surfaces showed transgranular cleavage which is characteristic of SCC, it was determined that SCC had occurred in the test piece.

The bending test and the creep test were performed in the same manner as described in Example 1 except that the bend radius was 4 mm in the bending test.

The test results are also included in Table 2.

As can be seen from Table 2, pure Zr could not withstand SCC in highly oxidizing nitric acid solutions when an anodic potential was applied or in highly concentrated nitric acid solutions at a concentration higher than the azeotropic point (Alloy No. 16). Addition of less than 5.0% Ti or less than 1.0% Ta was not effective for improving resistance to SCC in nitric acid (Alloys Nos. 17, 23, and 24). In contrast, addition of at least 5.0% Ti or 1.0% Ta according to the present invention produced a significant improvement in resistance to SCC. Particularly, when the content of Ti or Ta was at least 10%, SCC was no longer observed in nitric acid under all the conditions.

The bending strength deteriorated when the content of Ti, Fe, Cr, H, N, or oxygen was higher than the maximum content for the element restricted in the present invention.

Pure zirconium and zirconium alloys which contained less than 5.0% Ti or less than 1.0% Ta (Alloys Nos. 16, 23 and 24) had rather low creep strengths. In contrast, all the tested zirconium alloys according to the present invention had good creep strengths which were higher than 23 $kgf/mm^2$.

While the invention has been described with reference to the foregoing embodiments, various changes and modifications can be made thereto which fall within the scope of the appended claims.

TABLE 2

| No. | Composition of tested alloy (wt %) Ti | Ta | Fe | Cr | H | N | O | W | V | Mo | Bend Test | Resistance to SCC in SSRT test: Const. potential applied, 70% $HNO_3$ 1.3V | 1.4V | 1.5V | No potential applied, different $HNO_3$ conc. 40% | 70% | 80% | 98% | Creep strength ($kgf/mm^2$) (Stress at which minimum creep rate reaches $10^{-3}$%/h) | Remarks |
|---|---|---|---|---|---|---|---|---|---|---|---|---|---|---|---|---|---|---|---|---|
| 1 | 5.50 | — | 0.042 | 0.014 | 0.0032 | 0.0013 | 0.063 | — | — | — | O | O | X | X | O | O | O | X | 23.5 | This |
| 2 | 10.38 | — | 0.071 | 0.012 | 0.0010 | 0.0042 | 0.143 | — | — | — | O | O | O | O | O | O | O | O | 34.1 | Invention |
| 3 | 18.27 | — | 0.083 | 0.085 | 0.0013 | 0.0017 | 0.110 | — | — | — | O | O | O | O | O | O | O | O | 45.4 | |
| 4 | 25.14 | — | 0.145 | 0.026 | 0.0016 | 0.0017 | 0.112 | — | — | — | O | O | O | O | O | O | O | O | — | |
| 5 | 28.27 | — | 0.247 | 0.021 | 0.0009 | 0.0011 | 0.123 | — | — | — | O | O | O | O | O | O | O | O | 58.9 | |
| 6 | — | 1.22 | 0.042 | 0.014 | 0.0031 | 0.0013 | 0.112 | — | — | — | O | O | X | X | O | O | X | X | 25.6 | |
| 7 | — | 5.14 | 0.071 | 0.013 | 0.0010 | 0.0017 | 0.121 | — | — | — | O | O | O | X | O | O | O | X | 35.6 | |
| 8 | — | 12.34 | 0.065 | 0.017 | 0.0012 | 0.0014 | 0.124 | — | — | — | O | O | O | O | O | O | O | O | 43.5 | |
| 9 | 5.41 | 10.68 | 0.084 | 0.026 | 0.0011 | 0.0014 | 0.101 | — | — | — | O | O | O | O | O | O | O | O | 62.2 | |
| 10 | 25.21 | 11.20 | 0.055 | 0.094 | 0.0009 | 0.0015 | 0.112 | — | — | — | O | O | O | O | O | O | O | O | 84.2 | |
| 11 | 10.12 | 5.56 | 0.069 | 0.021 | 0.0013 | 0.0013 | 0.097 | — | — | — | O | O | O | O | O | O | O | O | 50.8 | |
| 12 | 10.28 | 5.06 | 0.041 | 0.034 | 0.0011 | 0.0012 | 0.098 | 0.14 | — | — | O | O | O | O | O | O | O | O | 71.3 | |
| 13 | 10.41 | 5.24 | 0.052 | 0.036 | 0.0011 | 0.0011 | 0.102 | 0.52 | — | — | O | O | O | O | O | O | O | O | 31.2 | |
| 14 | 10.34 | 5.22 | 0.078 | 0.048 | 0.0012 | 0.0014 | 0.089 | — | 0.56 | — | O | O | O | O | O | O | O | O | 30.8 | |
| 15 | 10.47 | 5.37 | 0.074 | 0.037 | 0.0008 | 0.0017 | 0.108 | — | — | 0.41 | O | O | O | O | O | O | O | O | 30.4 | |
| 16 | —* | —* | 0.040 | 0.017 | 0.0042 | 0.0012 | 0.119 | — | — | — | O | X | X | X | O | O | X | X | 17.8 | Comparative |
| 17 | 1.2 | — | 0.087 | 0.012 | 0.0037 | 0.0010 | 0.132 | — | — | — | O | X | X | X | O | O | X | X | — | |
| 18 | 37.18 | — | 0.126 | 0.093 | 0.0026 | 0.0013 | 0.170 | — | — | — | X | O | O | O | O | O | O | O | — | |
| 19 | 21.26 | — | 0.418 | 0.271 | 0.0012 | 0.0061 | 0.140 | — | — | — | X | O | O | O | O | O | O | O | — | |
| 20 | 20.90 | — | 0.156 | 0.092 | 0.0154 | 0.0025 | 0.125 | — | — | — | X | O | O | O | O | O | O | O | 47.5 | |
| 21 | 23.25 | — | 0.172 | 0.093 | 0.0032 | 0.0821 | 0.163 | — | — | — | X | O | O | O | O | O | O | O | — | |
| 22 | 28.18 | — | 0.177 | 0.094 | 0.0035 | 0.0028 | 0.294 | — | — | — | X | O | O | O | O | O | O | O | 67.6 | |
| 23 | — | 0.21 | 0.087 | 0.019 | 0.0016 | 0.0041 | 0.108 | — | — | — | O | X | X | X | O | O | X | X | 19.8 | |
| 24 | 3.14 | — | 0.061 | 0.026 | 0.0018 | 0.0024 | 0.104 | — | — | — | O | O | X | X | O | O | X | X | 20.3 | |

(Note) Chemical Composition:
The balance is zirconium; *Pure zirconium.
Underlined contents are outside the range of the present invention.
—: Not added.
Bending test: O: No cracking; X: Cracking.
SSRT test: O: No SCC occurred; X: SCC occurred.
Creep test: —: Not tested.

What is claimed is:

1. A zirconium alloy having improved resistance to general corrosion and stress corrosion cracking in nitric acid and good creep strength and bending properties, which consists essentially of, by weight percent:

Ta: 1.0–20%,

Fe: not greater than 0.3%, Cr: not greater than 0.1%, oxygen: 0.05–0.2%, N: not greater than 0.05%, H: not greater than 0.01%, one or more of W, V, and Mo: 0–3.0% in total, and the balance Zr and inevitable impurities.

2. A zirconium alloy according to claim 1, wherein the content of Ta is at least 5%.

3. A zirconium alloy according to claim 1, wherein the content of Ta is 10–15%.

4. A zirconium alloy according to claim 1, wherein the content of Fe is not greater than 0.15%.

5. A zirconium alloy according to claim 1, wherein the content of Cr is not greater than 0.05%.

6. A zirconium alloy according to claim 1, wherein the content of oxygen is 0.08–0.15%.

7. A zirconium alloy according to claim 1, wherein the content of N is not greater than 0.01%.

8. A zirconium alloy according to claim 1, wherein the content of H is not greater than 0.005%.

9. A zirconium alloy according to claim 1, wherein the total content of W, V, and Mo is at least 0.05%.

10. A zirconium alloy according to claim 1, wherein the total content of W, V, and Mo is 0.05–2.0%.

11. A zirconium alloy according to claim 1, wherein the zirconium alloy comprises a structural element which is exposed to highly concentrated nitric acid.

12. A zirconium alloy according to claim 1, wherein the zirconium alloy has a creep strength of at least 23 $kgf/mm^2$.

13. A zirconium alloy having improved resistance to stress corrosion cracking in nitric acid solutions at a concentration above the azeotropic concentration and good creep strength and bending properties, which consists essentially of, by weight percent:

Ta: 1.0–20%,

Fe: not greater than 0.3%, Cr: not greater than 0.1%, oxygen: 0.05–0.2%, N: not greater than 0.05%, H: not greater than 0.01%, and the balance Zr and inevitable impurities.

14. A zirconium alloy according to claim 13 which contains Ta in an amount of at least 15. A zirconium alloy having improved resistance to stress corrosion cracking in nitric acid solutions at a concentration above the azeotropic concentration and good creep strength and bending properties, which consists essentially of, by weight percent:

one or both of Ti: 5.0–30% and Ta: 1.0–20%,

Fe: not greater than 0.3%, Cr: not greater than 0.1%,

Oxygen: 0.05–0.2%, N: not greater than 0.05%,

H: not greater than 0.01%, one or more of W, V, and Mo: 0.05–3.0% in total, and the balance Zr and inevitable impurities.

16. A zirconium alloy according to claim 15 which contains at least one of Ti and Ta in an amount of at least 10%.

17. A zirconium alloy according to claim 15, wherein the total content of W, V, and Mo is at most 2.0%.

18. A zirconium alloy according to claim 15, wherein the content of Ti is 10–25%.

* * * * *